United States Patent [19]

Fitzwater

[11] Patent Number: 4,768,406

[45] Date of Patent: Sep. 6, 1988

[54] TORQUE COMPENSATING APPARATUS

[76] Inventor: Edwin Fitzwater, 1370 Bryant St., Rahway, N.J. 07065

[21] Appl. No.: 854,513

[22] Filed: Apr. 22, 1986

[51] Int. Cl.[4] ..... B25G 1/10

[52] U.S. Cl. ..... 81/177.1; 81/177.6; 74/551.9

[58] Field of Search ..... 81/177.1, 177.6, 489, 81/900; 16/110 R, DIG. 12; D8/DIG. 7, DIG. 8; 74/551.9

[56] References Cited

U.S. PATENT DOCUMENTS

| | | | |
|---|---|---|---|
| 1,642,569 | 9/1927 | Winslow et al. | 81/177.1 |
| 2,162,117 | 6/1939 | Perry | 81/489 |
| 3,189,069 | 6/1965 | Stowell | 81/177.1 |
| 3,340,914 | 9/1967 | Ricks | 81/177.1 |
| 4,031,775 | 6/1977 | Petty | 16/110 R X |
| 4,488,460 | 12/1984 | Ballone et al. | 81/121.1 X |
| 4,599,920 | 7/1986 | Schmid | 81/177.6 X |

*Primary Examiner*—Debra Meislin

*Attorney, Agent, or Firm*—Jeffery S. Mednick

[57] ABSTRACT

An apparatus, such as a screw driver, has a working member and a handle attached to the working member. The handle is of a predetermined cross-sectional shape when the tool is at rest. When incremental torque is applied to the handle is changes from the predetermined cross-sectional shape to another cross-sectional shape. As a result, the tool can have a cross-sectional shape, such as round, for low torque uses and a more suitable cross-sectional shape, such as oblong or triangular, for high torque uses. The handle returns to its predetermined shape when the high torque is released.

24 Claims, 4 Drawing Sheets

Fig. 10.
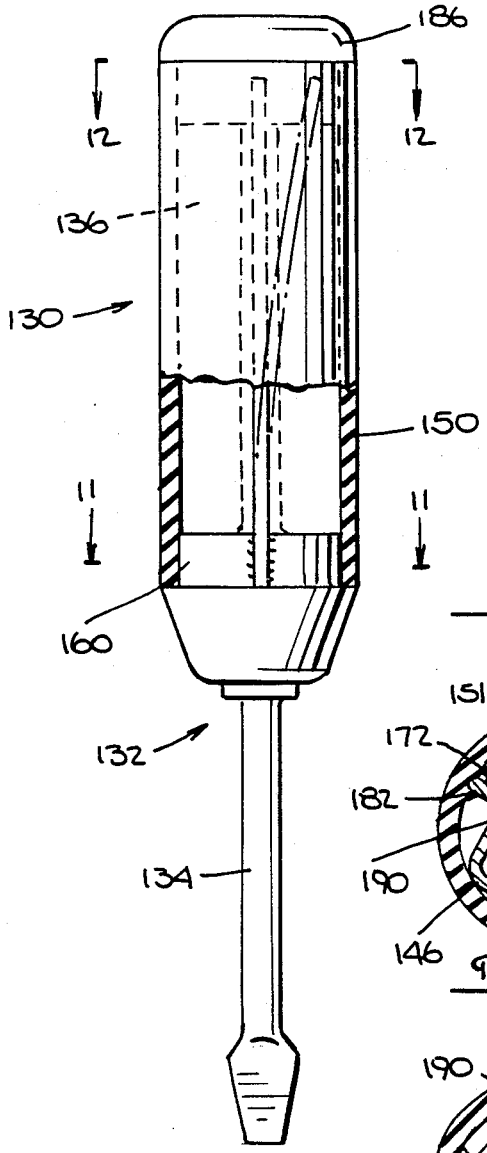
Fig. 14.
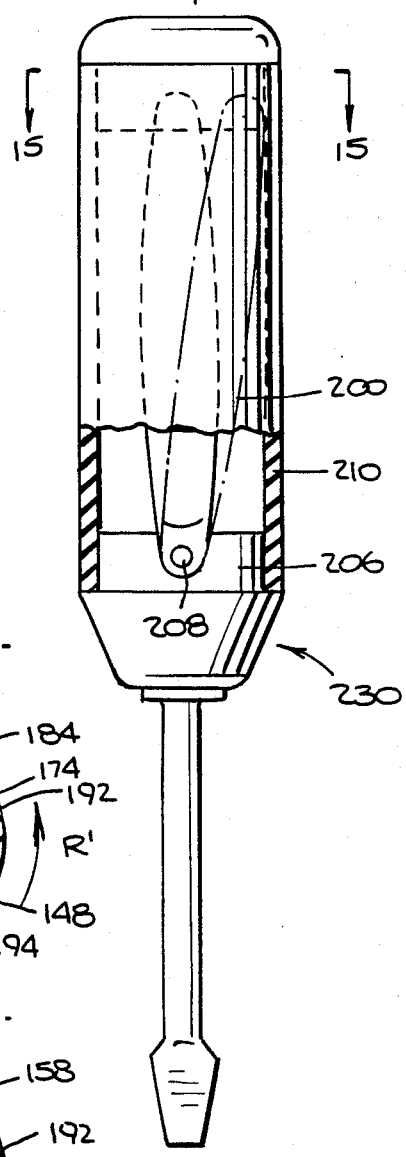
Fig. 12.
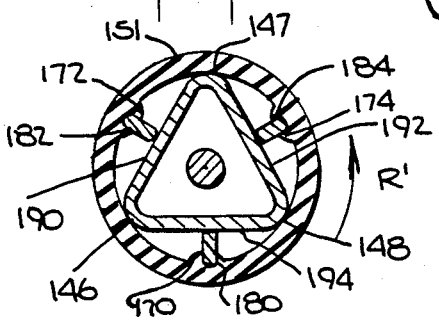
Fig. 13.
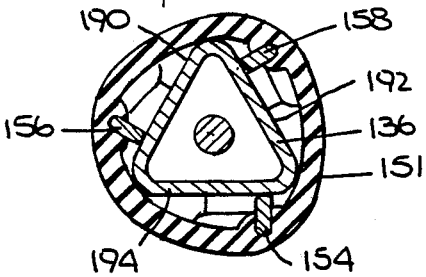
Fig. 11.
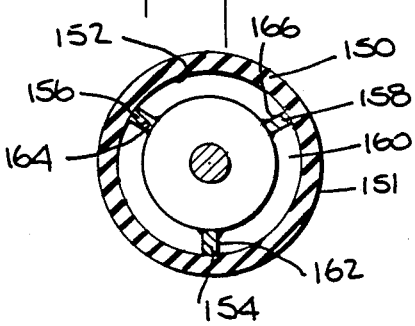
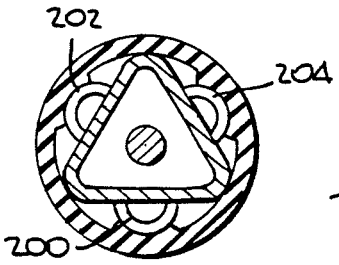
Fig. 16.
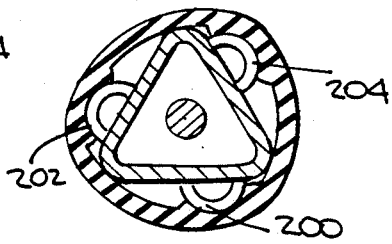
Fig. 15.

Fig. 17.
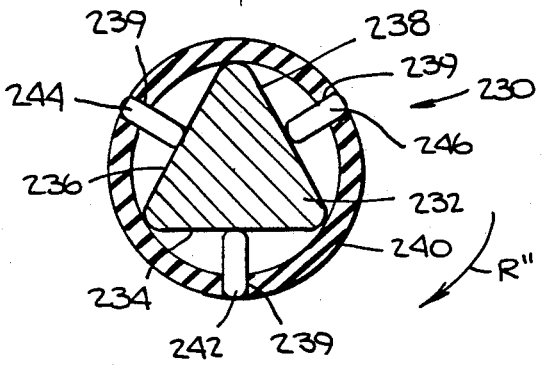
Fig. 17A.
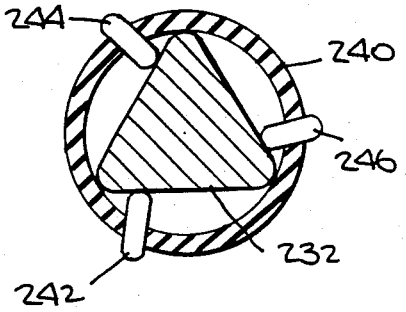
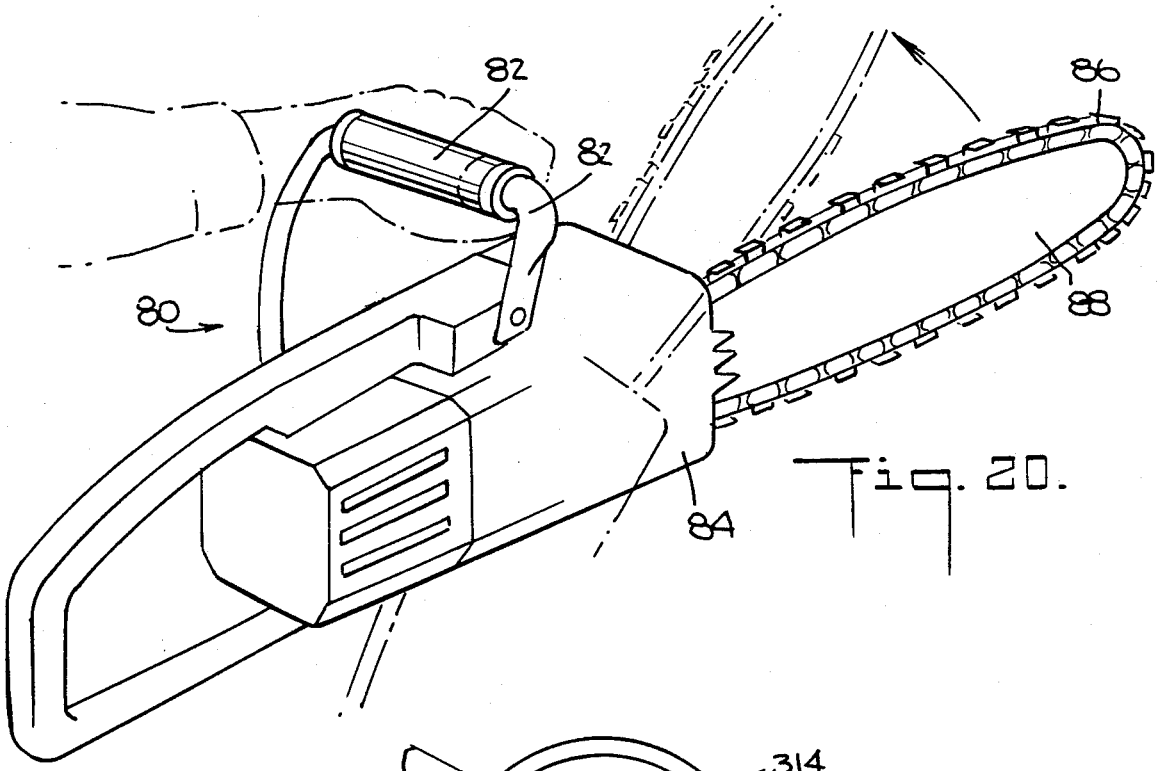
Fig. 20.
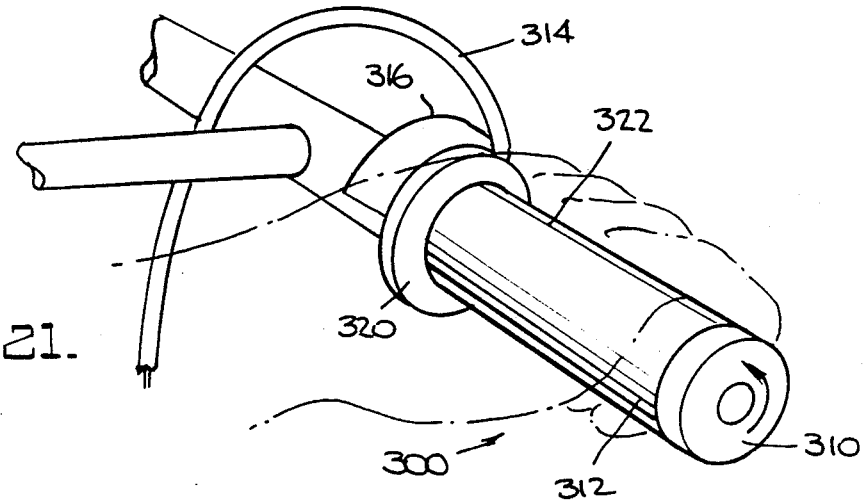
Fig. 21.

TORQUE COMPENSATING APPARATUS

FIELD OF THE INVENTION

The present invention relates to an improved apparatus, such as a screw driver or other hand-held implement, and more particularly to a tool having a handle that changes its cross-sectional shape as torque is applied.

BACKGROUND OF THE INVENTION

Handles for hand tools and various implements are quite old and highly developed in the prior art. The handles for most hand tools are generally cylindrically shaped and may be longitudinally fluted for a better grip.

In an apparent attempt to increase the degree of leverage that a user could apply to the tool, the prior art has suggested various shaped handles. While these tools have often been sufficient for high torque uses, they have been inconvenient for low torque uses. For example, when inserting a machine screw with a screw driver, little torque is required. It would be convenient for the user to spin the handle in his fingers, but this could be difficult with an odd-shaped handle. The user could use a screw driver having a handle of regular cross section (such as circular), but this screw driver would not be too suitable for high torque uses.

Ergonomic handles have been proposed, such as, for example, the one in U.S. Pat. No. 4,488,460, to provide convenient and comfortable grips over extended periods of time. However, these handles still fail to provide convenience during low torque operation.

SUMMARY OF THE INVENTION

Accordingly, it is an object of the present invention to provide an apparatus, such as a screw driver, with a handle having an automatic torque adjusting grip.

It is a further object of the present invention to provide an apparatus that is relatively easy and inexpensive to manufacture.

It is a further object of the present invention to provide an apparatus that is safer for operators to use.

In accordance with the teachings of the present invention a new and improved apparatus is provided. The apparatus may be a hand tool, such as a screw driver, or a power tool, such as a chain saw or even a vehicle, such as a motorcycle. In any case, a unique handle is attached to a working member. In the case of a screw driver, the working member is a shaft with a screw driver blade on the far end. In the case of a chain saw, the working member is the housing that encloses the engine or motor and the bar and chain. In the case of a motorcycle, the working member is the accelerator cable or cables. In each of the above, the handle is of predetermined cross-sectional shape when little or no torque is applied to it. When torque is applied to the handle, means within the handle causes the handle to automatically change its cross-sectional shape. In the case of a screw driver, this change in shape permits the user to get a better grip and therefore apply more torque. In the case of a chain saw, the unique structure of the handle provides a safety advantage in that it minimizes the hazards of "kick-back". In the case of a motorcycle, the invention provides a structure that reduces operator fatigue.

These and other objects and advantages of the present invention will become apparent from a reading of the following specification taken in conjunction with the enclosed drawings.

BRIEF DESCRIPTION OF THE DRAWINGS

FIG. 10 is a cross-sectional view of an alternate embodiment of the present invention;

FIG. 11 is a cross-sectional view taken along lines 11—11 of FIG. 10;

FIG. 12 is a cross-sectional view taken along lines 12—12 of FIG. 10;

FIG. 13 is a cross-sectional view similar to FIG. 12, but showing the handle deflected under torque;

FIG. 14 is a cross-sectional view of another alternate embodiment of the present invention;

FIG. 15 is a cross-sectional view taken along 15—15 of FIG. 14;

FIG. 16 is a cross-sectional view showing the handle in FIG. 15 deflected under torque;

FIG. 17 is a cross-sectional view of another alternate embodiment of the present invention;

FIG. 17A is a cross-sectional view of the embodiment illustrated in FIG. 17, but in the torqued position;

FIG. 20 is a perspective view of a chain saw incorporating the features of the present invention; and FIG. 21 is a perspective view of a motor cycle handle bar incorporating the features of the present invention.

DESCRIPTION OF THE PREFERRED EMBODIMENT

Figure 1:
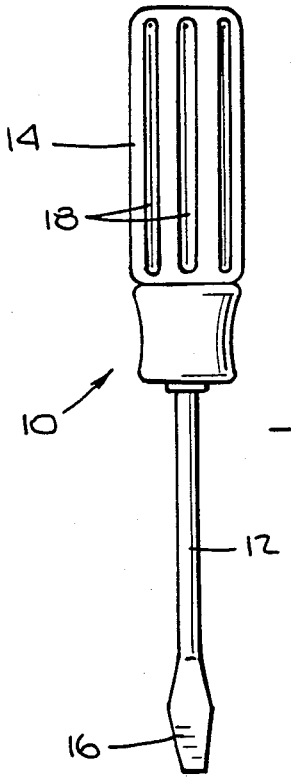
FIGS. 1 and 2 are side elevations of typical prior art hand tools.
Figure 2:
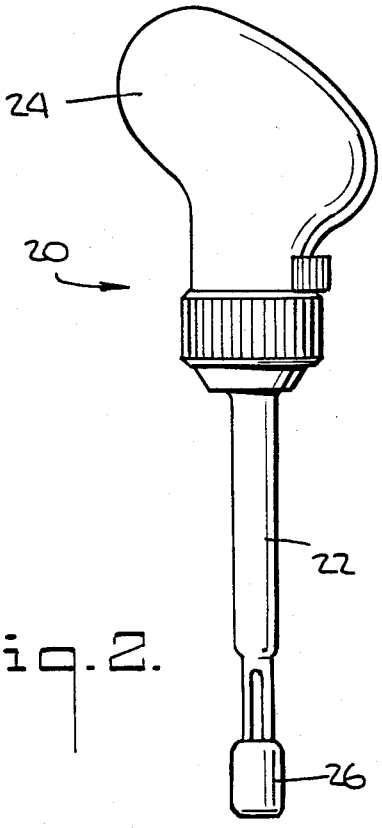

With reference to FIGS. 1 and 2, there is illustrated two prior art screw drivers. Screw driver 10 in FIG. 1 is of the type that is most commonly available. In this screw driver, steel or metal shaft 12 extends into an opening (not shown) in the bottom of handle 14. Normally, the end of shaft 12 extending into handle 14 will be of irregular shape or have a projection extending longitudinally. The internal surface of handle 14 will have a corresponding female shape so that torque can be transmitted from the handle 14 to the shaft 12. At the far end of shaft 12 is screw driver blade 16. While a plain blade has been illustrated it will be understood by one skilled in the art that any suitable driver, such as a phillips driver or even a socket driver could be used.

Referring to FIG. 2, there is illustrated a hand tool 20 of the type described in U.S. Pat. No. 4,488,460. Tool 20 includes shank 22 attached to ergonomic handle 24. At the far end of shank 22 is a socket driver 26. While the patent discloses a complicated ratchet mechanism for attaching shank 22 to handle 24, any simple attachment means such as the one discussed above may be used.

One can easily see that screw driver 10 may be conveniently ulilized in low torque situations by merely grasping handle 14 in the user's fingers and spinning the handle. For high torque situations, the user could slide his hand down the handle so that the could use his fingers and his palm for a better grip. But, because of the circular cross section of handle 14, the user would have relative difficulty getting a good grip even if the exterior surface of the handle had axially extending grooves, such as grooves 18, or was roughened (not illustrated). Hand tool 20 presents the opposite situation. For high torque situations, the user could wrap his fingers and palm around handle 24. But for low torque situations, the user would have difficulty spinning hand tool 20 in his fingers.

Figure 3:
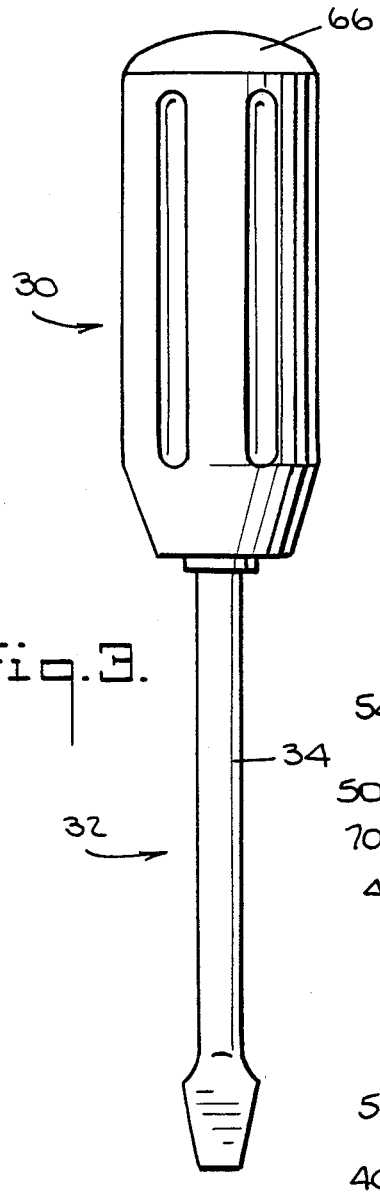
FIG. 3 is a side elevation of a screw driver made in accordance with the present invention.
Figure 4:
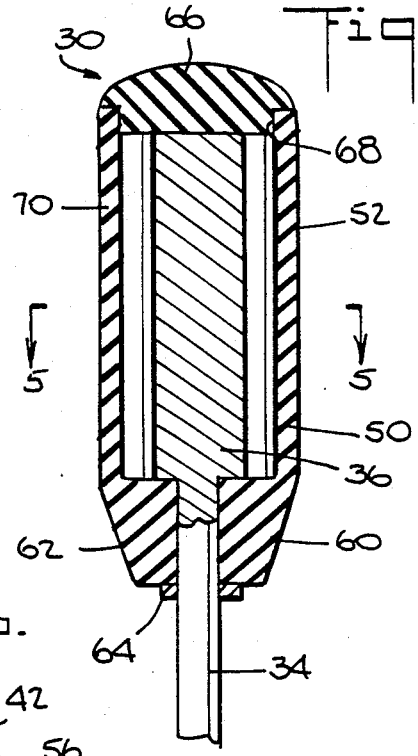
FIG. 4 is a cross-sectional view of a portion of the screw driver in FIG. 3 made in accordance with the present invention.
Figure 5:
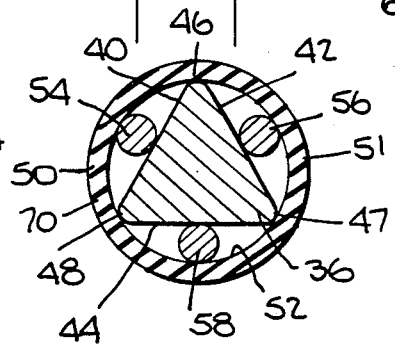
FIG. 5 is a cross-sectional view taken along the lines 5—5 of FIG. 4.

Referring to FIGS. 3 to 5, there is illustrated screw driver 30 that has many of the advantages of screw driver 10 and tool 20. Screw driver 30 includes a shank 32 having a first portion 34 and a second portion 36 attached thereto. At the end of first portion 34 (farthest from second postion 36) is a force transmitting means such as blade or projection 38. When used in this specification the term "working member" shall include the first portion of a shank with a force transmitting means, such as, but not limited to, the one illustrated in FIGS. 3 to 5. While a blade 38 has been illustrated, it is only one of many types of force transmitting means that will be apparent to one skilled in the art. Other examples are phillips drivers and sockets. Shank 32 may be made of any suitable material, but preferably it is made of a rigid material such as steel, metal or hard plastic. The material must be strong enough to resist substantial torque.

As shown in FIG. 5, second portion 36 may be triangular in cross section having sides or cam surfaces 40,42 and 44. Surrounding second portion 36 is a resilient or elastomeric enclosure 50, preferably having an external surface 51 circular in cross section. While grooves in external surface 51 are shown for increased friction, they are well known in the art. Internal surface 52 is constructed so that it engages corners 46,47 and 48 of second portion 36. Between each side or cam surface 40,42 and 44 and internal surface 52 is an elongated member 54,56,58 respectively. These elongated members are preferably rigid rods. At one end of enclosure 50 is an enlarged portion 60 surrounding some of first portion 34. External surface 62 is shown as being tapered but it should be understood that this is for aesthetics. Cap 64 may be used to finish the joint between first portion 34 and enclosure 50. At the other end of enclosure 50 is a cap 66. Enlarged portion 69 and cap 66 close off the space defined by internal surface 52. As shown, cap 66 includes a shoulder 68 projecting into enclosure 50 and engaging internal surface 52. While it is enclosure 50, second portion 36, rods 54,56 and 58, and cap 66 that define the handle of screw driver 30, those skilled in the art will recognize that the present invention is not limited to the device illustrated in FIGS. 3,4, or 5 and does not necessarily include all of the elements illustrated.

Figure 5A:
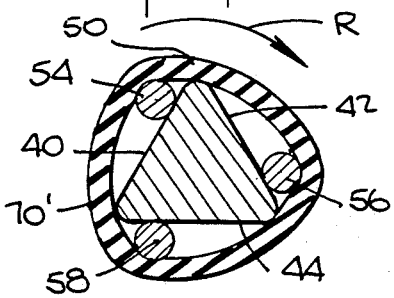
FIG. 5A is a cross-sectional view similar to the one in FIG. 5, but with torque applied to the handle.

For better understanding of the present invention, reference is made to FIG. 5A, which is a cross-sectional view similar to FIG. 5 but with torque applied in the direction of arrow R. As shown, torque applied to enclosure 50 causes rods 54,56 and 58 to roll along sides 40,42 and 44, respectively, of second portion 36. This causes the external surface 51 to automatically change from a first predetermined cross-sectional shape 70 (FIG. 5) to an irregular cross-sectional shape 70' (FIG. 5A).

Figure 18:
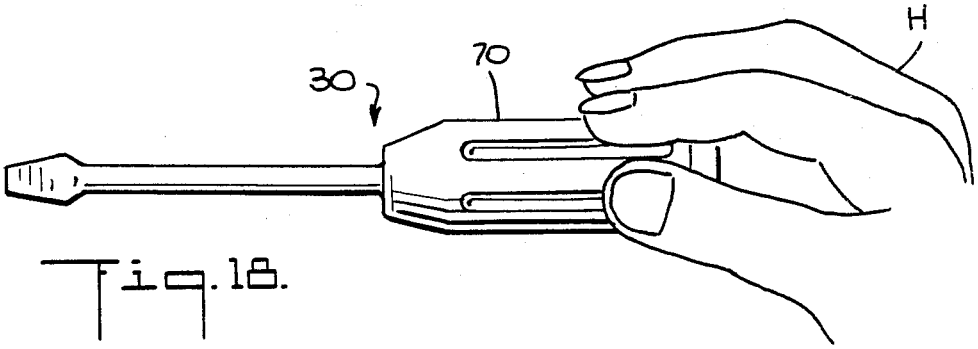
FIG. 18 illustrates a typical orientation of an operator's hand as he utilizes a screw driver made in accordance with the present invention in a low torque mode.
Figure 19:
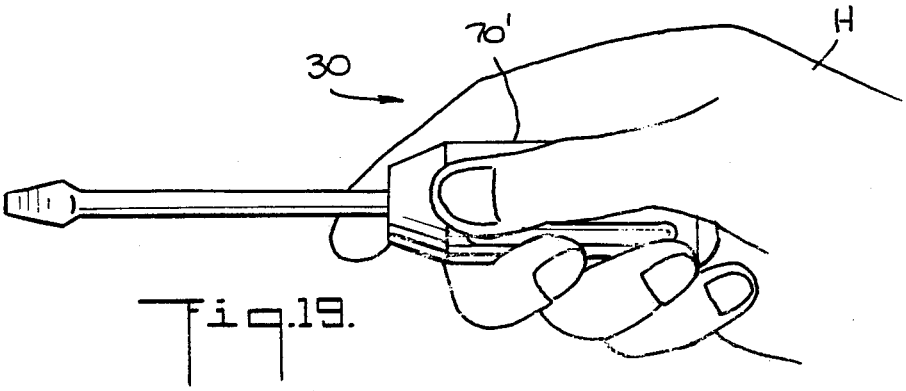
FIG. 19 illustrates a typical orientation of an operator's hand as he utilizes a screw driver made in accordance with the present invention in a high torque mode.

Referring to FIGS. 18 and 19, the present invention will become even more clear. FIG. 18 shows the band H of an operator gripping screw driver 30 for a low torque use. As shown, it is convenient to grip the screw driver with fingers alone and rotate it. A circular cross-sectional shape 70 is usually desirable. FIG. 19 shows the same hand H gripping screw driver 30 for a high torque use. As shown, the operator will usually slide the screw driver further into his hand to get a better grip. With the present invention, as the operator applies torque to the handle its external surface changes to an irregular cross-sectional shape 70'. This permits the operator to get a better grip on the handle and apply even more torque. When the operator releases the torque from the handle it returns to its original shape due to the resilience of enclosure 50.

Referring to FIGS. 6 to 9, there is shown other embodiments of the present invention. In each case, the handle is constructed so that its external surface automatically changes from a first cross-sectional shape to a second cross-sectional shape as torque is applied. When torque is released, the external surface automatically returns to the original shape. Since the features of these other embodiments are basically similar to the features of screw driver 30, only the structure of the handle will be discussed.

Figure 9:
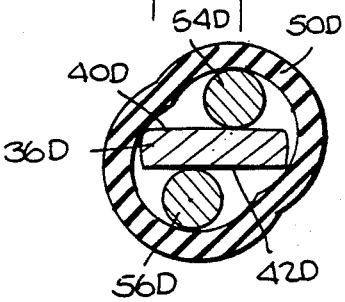
FIGS. 6 through 9 are cross-sectional views similar to the one in FIG. 5, but showing alternate embodiments of the present invention.
Figure 6:
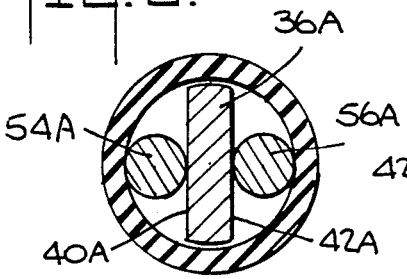
Figure 7:
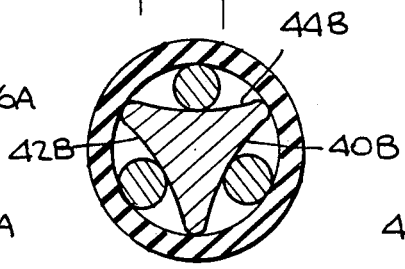
Figure 8:
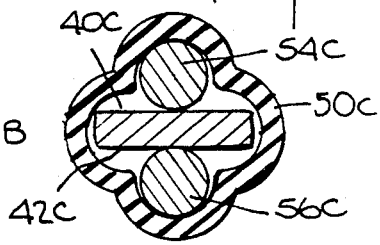

The embodiment shown in FIG. 6 is similar to the one previously discribed except that second portion 36A has only two major surfaces 40A and 42A and there are only two rods 54A and 56A. The embodiment shown in FIG. 7 is similar to the one illustrated in FIGS. 3 to 5 except that sides 40B, 42B and 44B are concave curves. Obviously, these surfaces may comprise a plurality of short, straight segments. FIGS. 8 and 9 illustrate embodiments where the intial shape of the external surface of the enclosure is not round. In FIG. 8, resilient enclosure 50C comprises four lobes. Rods 54C and 56C ride along sides 40C and 42C as torque is applied to enclosure 50C. In FIG. 9, enclosure 50D has two lobes and encircles second portion 36D with sides 40D and 42D. Rods 54D and 56D ride along these sides.

Referring to FIGS. 10 to 13, there is illustrated yet another embodiment of the present invention. Screw driver 130 includes a shank 132 having a first portion 134 and a second portion 136 attached thereto. Screw driver 130 is very similar to screw driver 30 and, in the interest of brevity, only the differences will be described. In the present embodiment, resilient enclosure 150 has a external surface 151, preferably circular in cross-section. Internal surface 152 is constructed so that it engages corners 146,147 and 148 of second portion 136. Surfaces 190,192 and 194 extend between these corners.

At the bottom of resilient enclosure 150 is a base member 160 connected, such as by suitable adhesive, or interference fit, or both to the upper portion of first portion 134 which extends therethrough. Flexible members 154,156 and 158 are press fit into grooves 162,164 and 166, respectively, of base member 160.

At the upper end of resilient enclosure 150 are bulbous portions 170,172 and 174 having grooves 180,182 and 184 aligned with grooves 162,164 and 166, respectively, when the screw driver 130 is at rest. The upper ends of flexible members 154,156 and 158 are press fit into grooves 162,164 and 166, respectively. Cap 186 closes off the working parts.

As is best illustrated in FIGS. 12 and 13 when torque is applied to screw driver 130, in the direction of arrow R', members 154,156 and 158 slide along surfaces 190,192 and 194, respectively, thus changing the shape of external surface 151 to improve the grip. As in the other embodiments, when torque is relieved, surface 151 returns to its original shape. This is further helped by the flexible members returning to their original unstressed condition (like springs).

Referring to FIGS. 14 to 16, there is illustrated an embodiment that is similar to the one of FIGS. 10 to 13. In this embodiment, screw driver 230 includes pivoting members 200,202 and 204 enclosed in a resilient casing. These are used instead of flexible members and may consist of formed metal or plastic sheets. Each pivoting member is connected to base member 206 by a suitable means such as pivot pin 208. FIGS. 15 and 16 show how the shape of the handle changes when torque is applied.

Hereinabove, what has been described is an apparatus having a handle that changes shape in response to torque by having members move in a rotary direction about a core. The members could roll upon cam surfaces or could be cantilivered. One skilled in the art will recognize that there are other ways of constructing the handle so that its cross-sectional shape changes in response to torque. One such way is illustrated in FIG. 17. This Figure shows a screw driver 230 having a triangular core 232 with cam surfaces 234,236 and 238. Core 232 is fixed to a shank (not shown). Surrounding core 232 is a cage 240 which may be molded of suitable rigid plastic. Sliding members 242,244 and 246 rest on surfaces 234,236 and 238 and are seated in guide slots 239 in cage 240. As shown in FIG. 17A, as the operator applies torque, cage 240 rotates about core 232, causing piston-like members 242,244 and 246 to move up cam surfaces 234,236 and 238, respectively of core 232. This causes sliding members 242,244 and 246 to extend through guide slots 239 and beyond cage 240 and change the effective external shape of the cage 240. If desirable, cage 240 could be covered with a flexible material. While the sliding members and the guide slots have been illustrated as being relatively narrow, it should be appreciated that in many circumstances increasing the width of both will be desirable. It will always be necessary, however, for the guide slots to enable the sliding members to move freely within the guide slots as the cage is rotated. One skilled in the art will recognize that while a screw driver has been illustrated, the present invention could be utilized with any apparatus subjected to varying torque. Further, other changes may be incorporated when desirable. For example, one may wish to incorporate gear-like teeth on the rods to engage mating gear-like teeth on either the sides of the second portion of the shank or the surface of the resilient member or both to insure a positive contact. Also, one may choose to pin or link the end of the rods to the upper cap or the enlarged portion of the resilient enclosure to keep the rods equispaced. Still further, one may choose to make the exterior surface of the handle smooth, or finely ribbed, or textured (or some combination of these) for better friction.

While the present invention has been described with respect to hand tools it is not limited to such. For example, if one incorporates the features of the present invention into the handle of a power tool the advantages set forth hereinabove will be achieved. In addition, as an example, the power tool will become a safer piece of equipment. For a better understanding, reference is made to chain saw 80 in FIG. 20. Chain saw 80 includes a handle 82 attached to housing 84 which encloses a motor (not shown). Chain 86 is powered by the motor and rotates about bar 88 in use. Anyone who has ever operated a chain saw appreciates how "kick-back" ads to the danger to the operator. However, if handle 82 is made in accordance with the teachings of the present invention, the operator will have better control of the chain saw because the operator's grip on the handle will automatically increase as torque is applied to the handle because of "kick-back." All that need be done is to construct handle 82 so that it changes shape under torque, as taught hereinabove. This can be done by, for example, mounting rigid rods about a triangular shaped member having a cross-sectional shape as shown in FIG. 5. As with screw drivers, as torque is released the handle will return to its original shape. The same principles may apply to other power tools.

Referring to FIG. 21, there is shown a view of a motor cycle handle bar 300 having a handle 310 which includes an accelerator grip 312. As is well known to one skilled in the art, a cable in sheath 314 is attached to a torque transfer box 316 so that rotation of accelerator grip 312 pulls the cable. The opposite end of the cable is attached to the carburator (not shown). In operation, when the operator rotates grip 312, the cable lifts a slide in the carburator and increases the speed of the motor cycle. If the operator wishes to move at a speed such as 50 miles per hour for an extended period of time, fatigue on his hand can be significant. However, if accelorator grip 312 is made in accordance with the present invention with a core member attached to a fixed portion 320 of handle bar 300 and with members (not illustrated) surrounding a cam surface so that the external surface 322 changes shape as torque is applied, effort is reduced and fatigue is minimized. This could be similar, for example, in cross section to the arrangement in FIG. 5.

Although the present invention has been described and illustrated above in detail, it is to be clearly understood that the same is by way of illustration and example only and is not to be taken by way of limitation. The spirit and scope of this invention are to be limited only by the terms of the appended claims.

What is claimed:

1. An apparatus comprising:

a working member;

a handle attached to said working member, said handle being of a predetermined cross-sectional shape when said apparatus is at rest;

said handle including a core member having a plurality of cam surfaces and a plurality of elongated members, each of which engages one of said plurality of cam surfaces;

first means for maintaining said plurality of elongated members against said plurality of cam surfaces; and said core member and said plurality of elongated members forming a second means for automatically changing said predetermined cross-sectional shape to another cross-sectional shape when torque is applied to said handle.

2. An apparatus as defined in claim 1, wherein said apparatus is a hand tool.

3. An apparatus as defined in claim 1, wherein said apparatus is a screw driver and said working member is a rod having a force transmitting means on one end.

4. An apparatus as defined in claim 3, wherein said force transmitting means is a projection.

5. An apparatus as defined in claim 1, wherein said apparatus is a torsion socket wrench and said working member is a rod having a force transmitting means on one end.

6. An apparatus as defined in claim 1, wherein said handle also includes a hollow elastomeric member surrounding said core member and said plurality of elongated members, said elastomeric member functioning as said first means.

7. An apparatus as defined in claim 6, wherein said plurality of elongated members are between said core member and said elastomeric member.

8. An apparatus as defined in claim 7, wherein said elastomeric member has an internal surface.

9. An apparatus as defined in claim 8, wherein each of said plurality of elongated members engages one of said plurality of cam surfaces and said internal surface of said elastomeric member.

10. An apparatus as defined in claim 9, wherein said plurality of cam surfaces is 2.

11. An apparatus as defined in claim 9, wherein said plurality of cam surfaces is 3.

12. An apparatus as defined in claim 9, wherein said plurality of cam surfaces is 4.

13. An apparatus as defined in claim 8, wherein said cam surfaces are curved.

14. An apparatus as defined in claim 8, wherein said cam surfaces are linear.

15. An apparatus as defined in claim 1, wherein said first means is a hollow rigid cage.

16. An apparatus as defined in claim 6, wherein said second means includes a base member at one end of said hollow elastomeric member and a cap at the other end of said hollow elastomeric member.

17. An apparatus as defined in claim 16, wherein said plurality of elongated members is within said hollow elastomeric member and extends between said base member and said cap.

18. An apparatus as defined in claim 17, wherein said plurality of elongated members are mounted in grooves in said base member and said hollow elastomeric member adjacent said cap.

19. An apparatus as defined in claim 17, wherein said plurality of elongated members are pinned for pivoting movement to said base member.

20. An apparatus as defined in claim 19, wherein said plurality of elongated members are mounted in grooves in said hollow elastomeric member adjacent said cap.

21. An apparatus as defined in claim 1, wherein said first means is a hollow rigid cage; a plurality of slots extending through said cage; and said plurality of elongated members extending through said slots.

22. An apparatus as defined in claim 1, wherein said apparatus is a power tool.

23. An apparatus as defined in claim 22, wherein said power tool is a chain saw.

24. An apparatus as defined in claim 1, wherein said apparatus is a motorcycle; said working member is a torque transfer box; and said handle is an accelerator grip.

* * * * *